US007111977B2

(12) United States Patent
Hiranuma et al.

(10) Patent No.: US 7,111,977 B2
(45) Date of Patent: Sep. 26, 2006

(54) PORTABLE WATCH

(75) Inventors: Haruki Hiranuma, Chiba (JP); Hisamitsu Yoshikawa, Chiba (JP)

(73) Assignee: Seiko Instruments Inc., (JP)

( * ) Notice: Subject to any disclaimer, the term of this patent is extended or adjusted under 35 U.S.C. 154(b) by 234 days.

(21) Appl. No.: 10/784,422

(22) Filed: Feb. 23, 2004

(65) Prior Publication Data

US 2005/0013202 A1 Jan. 20, 2005

(30) Foreign Application Priority Data

Mar. 10, 2003 (JP) ..... 2003-063250

(51) Int. Cl.
*G04B 37/00* (2006.01)

(52) U.S. Cl. ..... 368/289; 368/288; 368/308; 368/319

(58) Field of Classification Search ..... 368/190, 368/288–290, 319–321, 206, 216
See application file for complete search history.

(56) References Cited

U.S. PATENT DOCUMENTS 5,259,278 A * 11/1993 Leas ..... 81/180.1
5,492,937 A * 2/1996 Bogentoft et al. ..... 514/781
5,598,383 A * 1/1997 Li ..... 368/291
6,314,844 B1 * 11/2001 Warner ..... 81/440
6,581,494 B1 * 6/2003 Sechler ..... 74/594.1
2002/0033069 A1 * 3/2002 Sechler ..... 74/594.1

FOREIGN PATENT DOCUMENTS

JP 57046181 3/1982

* cited by examiner

*Primary Examiner*—David M. Gray
*Assistant Examiner*—Sean Kayes
(74) *Attorney, Agent, or Firm*—Adams & Wilks

(57) ABSTRACT

To provide a portable watch enabling components exchange around a crown while retaining the waterproof capability of a winding-stem-pipe attachment section when the screw lock capability is reduced. A winding stem pipe is screwed into a pipe-attachment hole of a case band for attachment in a removable manner. To an intracase-band end section of this winding stem pipe, provided is a screw section being a reverse screw to a first male screw section of the winding stem pipe screwed into the pipe-attachment hole. To this screw section, a clamp ring is screwed into in a removable manner. The case band is sandwiched by the ring and the extracase-band end section of the winding stem pipe screwed with the crown, and a waterproof gasket is sandwiched between the case band and the winding stem pipe. When the winding stem pipe receives the rotation forces in the loosening direction through the operation of the crown, the clamp ring is clamped to a greater degree, and the winding stem pipe does not loosen to a greater degree. As such, characteristically, there is no need for adhesive attachment of the winding stem pipe.

13 Claims, 7 Drawing Sheets

PORTABLE WATCH

BACKGROUND OF THE INVENTION

1. Field of the Invention

The present invention relates to a portable watch in which, structurally, a crown is so retained as not to accidentally rotate.

2. Description of the Prior Art

In a portable watch exemplified by a divers watch, adopted is the structure in which a crown is locked utilizing screw engagement (such a structure is referred to as screw lock in this specification) to prevent the crown from accidentally rotating when the portable watch is carried around.

The screw lock structure is the structure in which a case band including a watch movement is attached with a winding stem pipe, and to a male screw section formed to the outer rim of an extracase-band end section of the pipe, a female screw section locating at a crown main section to be fit to the extracase-band end section is screwed. With such a structure, under normal circumstances, the crown main section is screwed into the outer rim of the extracase-band end section so that the crown is locked. In order to operate the watch movement, the crown main section is unscrewed from the male screw section, and after pulling out the crown, a winding stem locating inside of the winding stem pipe can be operated for rotation.

With the conventional portable watch of such a screw lock structure, generally, a winding-stem-pipe-attachment section can be waterproof by brazing the winding stem pipe to the case band (see JP-A-57-46181 (from 8th line, right column, page 1 to 7th line, left column, page 2, FIGS. 1 and 2) as an example).

Other than the above, also known is another portable watch of a type aiming for waterproof capability of the winding-stem-pipe-attachment section. Therein, in the middle part of the winding stem pipe in the axial direction, a male screw section is provided separately from another male screw section to which a crown is screwed together so that the male screw section is screwed into the pipe-attachment hole of the case band, and after this screwing is completed, a waterproof gasket is sandwiched between the case band and the winding stem pipe.

In a portable watch with the screw lock structure, repeatedly operating the crown for rotation will cause both the screwed-tocrether female screw section of the crown and the male screw section of the winding stem pipe to be worn out or chipped, resultantly reducing the screw lock capability.

In such a case, the portable watch of JP-A-57-46181 in which the case band is brazed with the winding stem pipe does not allow exchange of components locating close to the crown if requiring removal of the winding stem pipe from the case band. There is thus no choice to exchange the watch exterior assembly including the case band. As such, there has been a demand for improvement thereof.

With a watch having a winding stem pipe screwed into a case band, it has been considered that, in principle, exchange is possible for components including the winding stem pipe, located close to the crown. Even with such a structure, however, the winding stem pipe receives rotation forces every time the crown is screwed into the winding stem pipe or every time this screwing is unscrewed. Accordingly, the screwing of the winding stem pipe into the case band becomes loose, resultantly possibly causing the waterproof capability achieved by a waterproof gasket to be reduced.

As measures against that, adhesive filling is sometimes done to the section at where the winding stem pipe and the case band are screwed together. If adhesive is used for attachment as such, the winding stem pipe becomes difficult to be removed from the case band, and in practical sense, exchange of components locating close to the crown becomes impossible. As a result, there has been no choice to exchange the watch exterior assembly including the case band if the screw lock capability is reduced. As such, there has been a demand for improvement thereof.

An object to be achieved by the present invention is to provide a portable watch capable of exchange of components located close to the crown when the screw lock capability is reduced while retaining waterproof capability of the winding-stem-pipe-attachment section.

SUMMARY OF THE INVENTION

In order to achieve the above object, the present invention is characterized in that, a screw section being a reverse screw for a first male screw section of a winding stem pipe to be screwed into a pipe-attachment hole of a case band in a removable manner is provided to an intracase-band end section of the winding stem pipe, a clamp ring is screwed together with the screw section of the intracase-band end section in a removable manner, the ring and the extracase-band end section of the winding stem pipe to which the crown is screwed sandwich the case band, and a waterproof gasket is sandwiched between the case band and the winding stem pipe.

In the present invention, responding to operation of the crown for exerting or canceling the screw lock capability, when the winding stem pipe receives the rotation forces in the direction to loosen, the clamp ring is fastened to a greater degree. In this manner, the winding stem pipe can be prevented from loosening without using adhesive to attach the winding stem pipe, and the waterproof capability of the waterproof gasket sandwiched between the pipe and the case band can be retained. Moreover, the clamp ring can be removed from the intracase-band end section of the winding stem pipe in the intracase-band side, and the winding stem pipe is also removable from the case band as being screw-in type. Therefore, even if the screw lock capability is reduced, the winding stem pipe and the crown can be separately exchanged.

In a preferable embodiment of the present invention, the outer diameter of a screw section of the intracase-band end section is formed to be smaller than the outer diameter of the first male screw section. This embodiment is considered superior in the respect that, when the screw section of the intracase-band end section is a male screw section, the winding stem pipe can be easily inserted or removed to/from the pipe-attachment hole while suppressing snagging between the screw section and the male screw section locating inside of the pipe-attachment hole of the case band.

In the preferable embodiment of the present invention, the clamp ring is a square nut. In this embodiment, in a case of attaching or removing the clamp ring to/from the intracase-band end section of the winding stem pipe, it becomes possible to operate the tool from the direction orthogonal to the axial line of the winding stem pipe. This is preferable for performing attachment/removal operation of the clamp ring in the intracase-band side being narrow.

In the preferable embodiment of the present invention, the extracase-band end section is provided with an engagement section for causing the extracase-band end section to be engaged with a tool for rotating the winding stem pipe. This engagement section is formed by a square hole opening toward the end plane of the extracase-band end section, or a hexagon exposing toward the outer rim plane of the extracase-band end section. This embodiment is preferable in the respect of rotating, using a tool, the winding stem pipe being difficult to operate for rotation directly by hands. Furthermore, at the time of attaching/removing the clamp ring, it is also preferable to retain the winding stem pipe using the tool not to rotate.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

In the below, described is a first embodiment of the present invention by referring to FIGS. 1 to 5.

Figure 1:
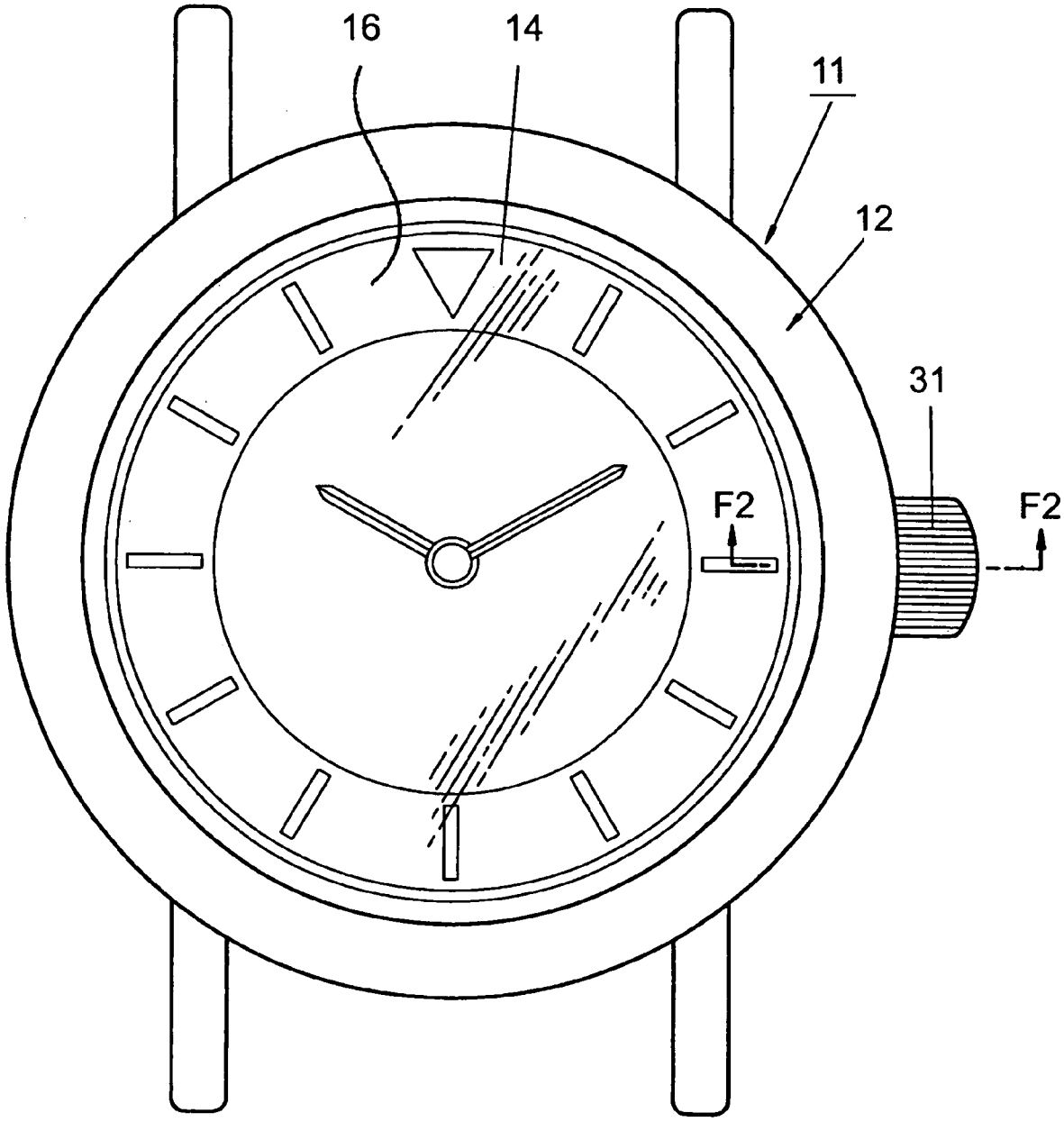
FIG. 1 is a front view of a divers watch according to a first embodiment of the present invention.

A reference numeral 11 in FIG. 1 shows a divers watch as a portable watch with screw lock capability for a crown. This watch 11 accommodates a watch movement, and the like, that are not shown in an watch exterior assembly 12. The watch movement is not restrictive, and may be the one whose power source is a small-sized battery or a spring, the one of a self-winding type, the one equipped for a digital watch displaying time or others in digital form on a dial by quartz oscillator module, or the one as a result of combining the one equipped for a digital watch and the one equipped for others.

The watch exterior assembly 12 is so formed that a cover glass 14 is attached to be liquid tight over an annular metallic case band 13 in its thickness direction, and a case back 15 (refer to FIG. 2) made of metal, and the like, is attached to be liquid tight over the back plane of the case band 13 in its thickness direction. A dial 16 and others can be seen through the cover glass 14, and the case back 15 can be removable.

Figure 2:
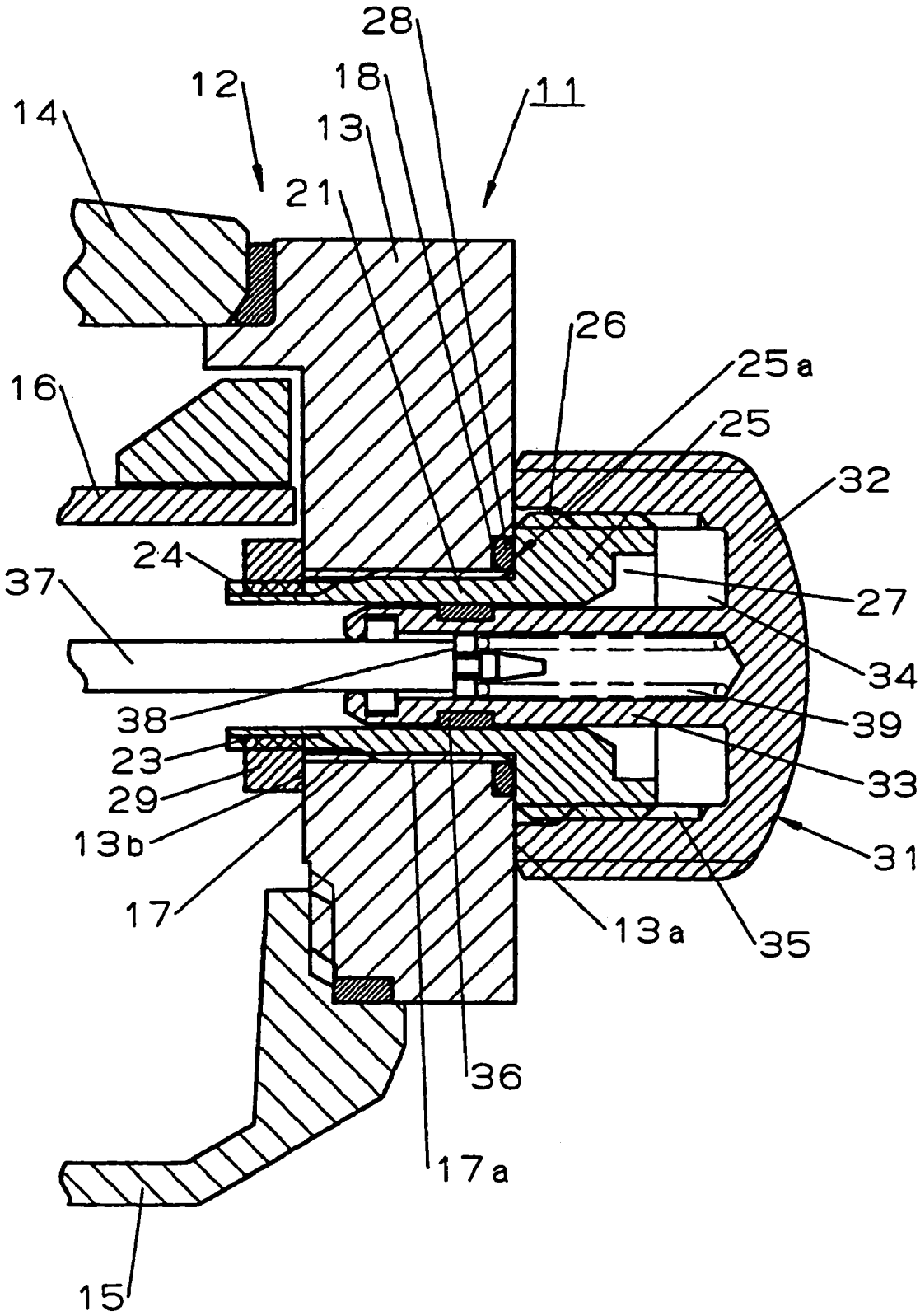
FIG. 2 is a cross-sectional view cut along an F2—F2 line in FIG. 1 with a crown screw locked.
Figure 4:
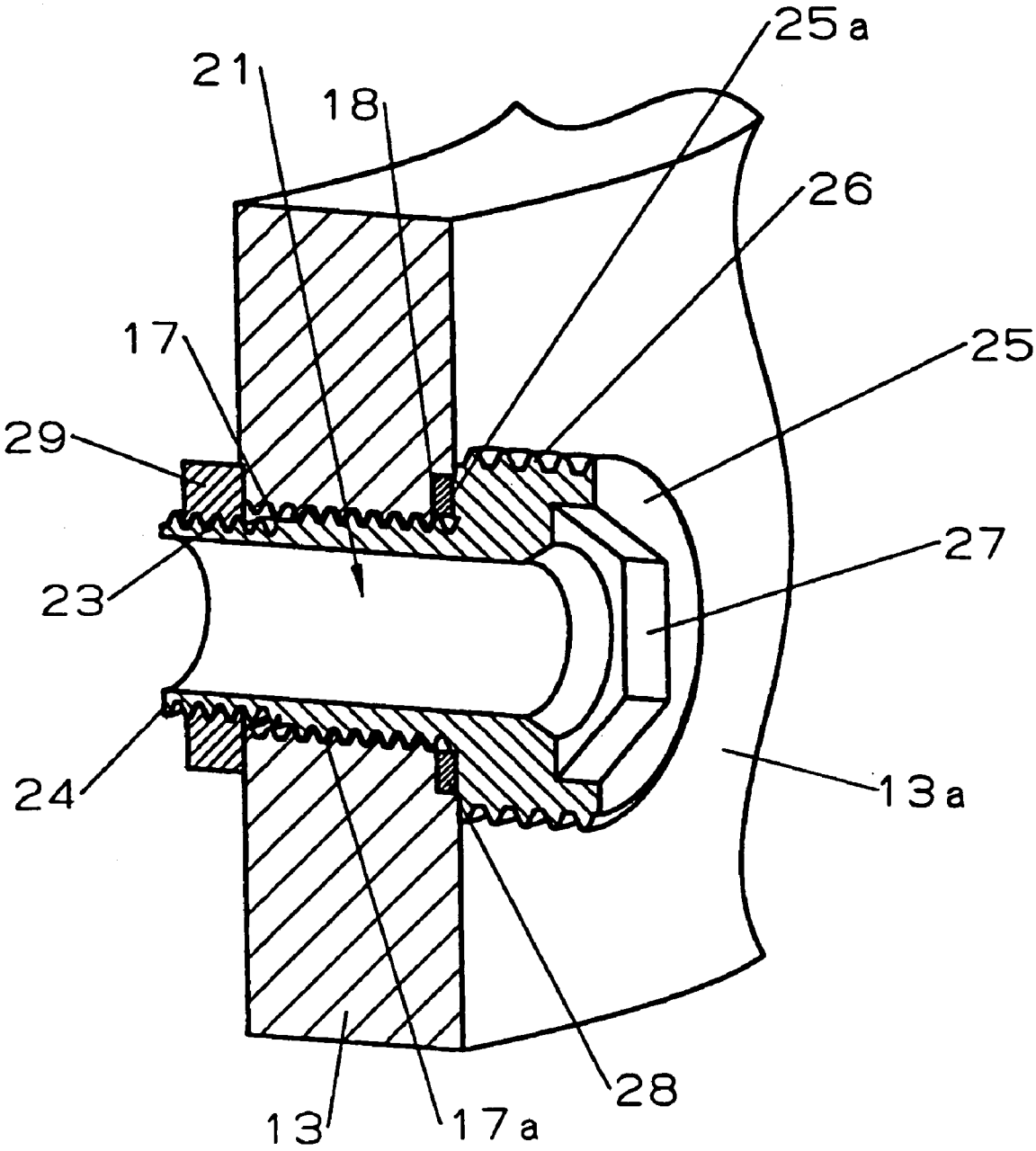
FIG. 4 is a perspective view of a cut-out view of the winding-stem-pipe-attachment section of the divers watch of FIG. 1.
Figure 5:
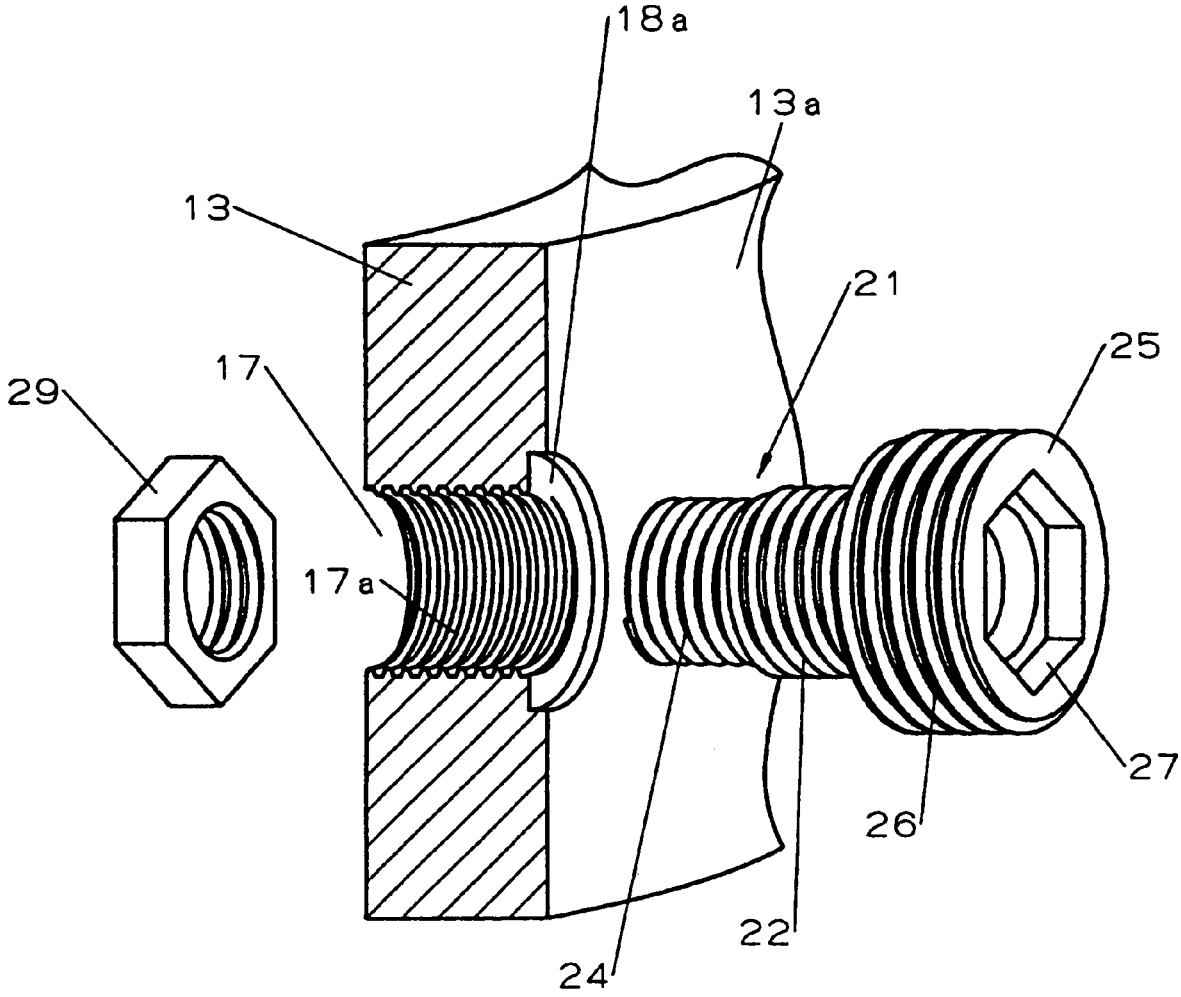
FIG. 5 is a perspective view showing a band case, a winding stem pipe, and a clamp ring of the divers watch of FIG. 1, all of which are disassembled from each other.

As shown in FIGS. 2, 4, and 5, the case band 13 has, at a part thereof, a pipe-attachment hole 17 going through the case band 13 in the diameter direction. The inner rim of the pipe-attachment hole 17 is formed with, for example, a female screw section 17*a* being a righthand screw (referred to also as positive screw). Note here that this female screw section 17 a may be a left-hand screw (referred to also as reverse screw). One end of the pipe-attachment hole 17 is open toward the inside of the case band, that is, inside of the watch exterior assembly 12, and the other end of the pipe-attachment hole 17 is open toward the outside of the case band, that is, outside of the watch exterior assembly 12. On the outer surface 13*a* of the case band 13, a gasket accommodation groove 18 is formed. This accommodation groove 18 is made larger in diameter than the pipe-attachment hole 17, and goes through the opening made on the extracase-band side of the hole 17 and is provided concentrically with the opening.

The case band 13 is attached with a metallic winding stem pipe 21 to be removable from the extracase-band side by going through the pipe-attachment hole 17.

In detail, as shown in FIGS. 2, 4, and 5, the winding stem pipe 21 is provided with a first male screw section 22 at the outer rim of the middle section thereof axially to the direction to be inserted into the pipe-attachment hole 17. The first male screw section 22 is a right-hand screw corresponding to the female screw section 17*a*, and is screwed together with this female screw section 17*a* in a removable manner.

The winding stem pipe 21 is provided with, at one end thereof in the axial direction, an intracase-band end section 23, which is so arranged as to protrude toward the intracase-band side after going through the pipe-attachment hole 17. The outer rim plane of the end section 23 is formed with a screw section 24. The screw section 24 is structured by a screw reverse to the first male screw section 22 being a right-hand screw, that is, structured by a male screw section being a left-hand screw in a first embodiment. The outer diameter of the screw section 24 is formed smaller than both the outer diameter of the first male screw section 22 and the inner diameter of the female screw section 17*a*. Through establishing of such a dimensional relationship, it becomes possible to insert or remove the winding stem pipe 21 to/from the pipe-attachment hole 17 while suppressing snagging between the screw section 24 being a male screw section and the female screw section 17*a* locating inside of the pipe-attachment hole 17.

The winding stem pipe 21 is provided with, at the other end thereof in the axial direction, an extracase-band end section 25 arranged on the extracase-band side. This end section 25 is in the form of an annular flange protruding outside in the diameter direction, and the outer diameter thereof is formed larger than that of the gasket accommodation groove 18. At the outer periphery of the extracase-band end section 25, a second male screw section 26 is provided. This second male screw section 26 may be either a right-hand screw or a left-hand screw, but preferably, it is preferable to have it a right-hand screw the same as the first male screw section 22.

Figure 3:
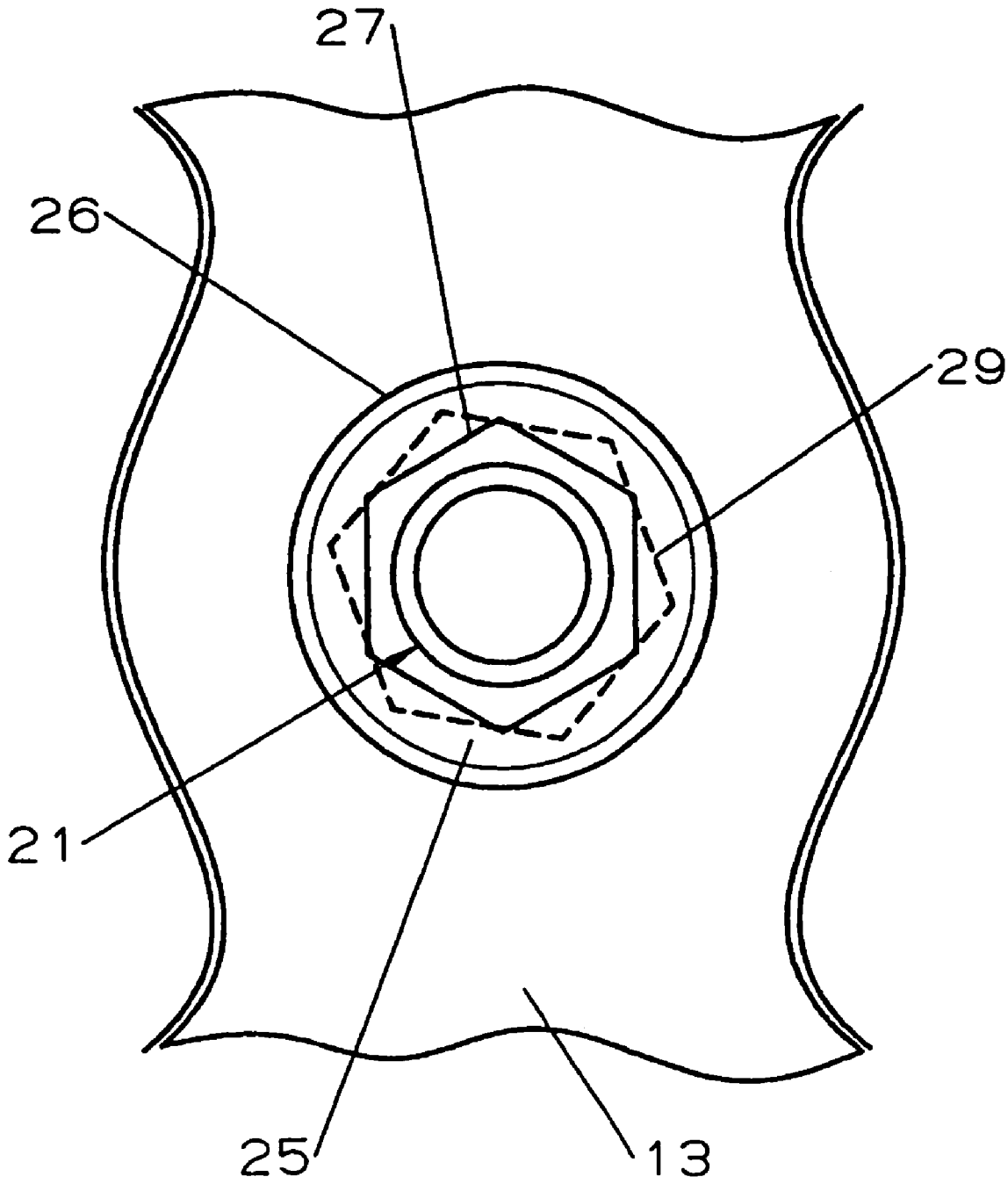
FIG. 3 is a front view of a winding-stem-pipe-attachment section with the crown of the divers watch of FIG. 1 removed.

The extracase-band end section 25 has an abutment surface or plane 25*a* that abuts with the outer surface 13*a* of the case band 13. This abutment plane 25*a* is formed by a plane made along in the direction orthogonal to the axial direction of the winding stem pipe 21. Further, the extracase-band end section 25 has an engagement section 27. As shown in FIG. 3, the engagement section 27 is formed by a hole shaped, for example, as a regular hexagon opening toward the end plane of the extracase-band end section 25. To this engagement section 27, a tool (not shown) for rotating the winding stem pipe 21, e.g., an end part of a hexagon wrench formed by bending a rod having across section of a hexagon to be L-shaped, can be inserted in a removable manner.

The winding stem pipe 21 structured as above is attached to the case band 13, the outer rim of which is engaged with a waterproof gasket 28 such as a rubber ring in such a manner as to abut to the abutment plane 25*a*, and is screwed into the pipe-attachment hole 17 from the intracase-band end section 23 from the outside of the case band 13. Through such attachment, the intracase-band end section 23 of the winding stem pipe 21 protrudes into the inside of the case band 13, and the extracase-band end section 25 is defined by position in the axial direction with its abutment plane 25*a* abutting to the outside plane 13*a* of the case band 13.

Through such attachment of the winding stem pipe 21, the waterproof gasket 28 is accommodated in the gasket accommodation groove 18, and also sandwiched between the furthest plane of the grove 18 and the abutment plane 25*a* by changing in shape due to its elasticity through compression. As a result, the waterproof gasket 28 is so provided for the purpose of achieving waterproof between the case band 13 and the winding stem pipe 21. The position to sandwich the waterproof gasket 28 is not limited, as long as locating between the case band 13 and the winding stem pipe 21. However, as in the present embodiment, placing it in such a manner as to exert the waterproof capability on the side exterior to the screwing part between the case band 13 and the winding stem pipe 21 is considered preferable in the respect of avoiding water to the screwing section.

To the screw section 24 of the intracase-band end section 23 of the winding stem pipe 21 located on the intracase-band side, a metallic clamp ring 29 is screwed in a removable manner. The clamp ring 29 is clamped until it abuts to the inner surface 13*b* (refer to FIG. 2) of the case band 13. Thereby, the pipe-attachment hole of the case band 13 and therearound is sandwiched by the extracase-band end section 25 of the winding stem pipe 21 and the clamp ring 29.

To the clamp ring 29, a square nut, for example, a hexagon nut as shown in FIGS. 3 and 5 can be preferably used. By adopting the clamp ring 29 made of a square nut, when the clamp ring 29 is attached or removed to/from the intracase-band end section 23 with the case back 15 removed, it becomes possible to operate a tool such as a spanner from the direction orthogonal to the axial line of the winding stem pipe 21. Thus, it allows for easy attachment/removal of the clamp ring 29 in the intracase, being narrow for a operation space.

A crown denoted by a reference numeral 31 in FIG. 1 is made of metal, and as shown in FIG. 2, is provided with a crown main section 32 and a crown tube section 33 extending in its entirety in the axial direction from the middle section thereof. To the crown main section 32, an annular clearance groove 34 is provided to enclose the base section of the crown tube section 33. A female screw section 35 is formed to the inner rim plane of the groove 34. The clearance groove 34 is a part into which the extracase-band end section 25 of the winding stem pipe 21 is inserted. The female screw section 35 is screwed together with the second male screw section 26 of the extracase-band end section 25 in a removable manner. Through such screwing, a so-called screw lock capability is exerted so that the crown 31 does not accidentally rotate when the watch 11 is carried around.

The crown tube section 33 is inserted into the winding stem pipe 21 from the extracase-band side. To an annular gasket attachment groove formed to the outer rim of the tube section 33, an annular waterproof rubber gasket 36 is attached. The waterproof gasket 36 is sandwiched between the inner rim plane of the winding stem pipe 21 and the outer rim plane of the crown tube section 33 by changing in shape due to its elasticity through compression, for the purpose of achieving waterproof therebetween. The crown tube section 33 is inserted with a winding stem 37 of the watch movement from the intracase-band side, and accommodating a coil spring 39 biasing the winding stem 37 in the axial direction via a spring bearing 38. The watch movement rotates in relation with the rotation operation of the crown 31 with the female screw section 35 being disengaged with the second male screw section 26, in other words, with screw lock released. In such a manner, time adjustment and others are carried out.

Described now is the attachment procedure for the winding stem pipe 21 to the case band 13 of the divers watch 11 structured as above.

First, the winding stem pipe 21 is inserted, from the screw section 24 thereof, to the pipe-attachment hole 17 of the case band 13 from the extracase-band side, and then screwed thereinto using a tool, which is not shown, engaged to the engagement section 27. This screwing is done with the waterproof gasket 28 previously fit in the gasket accommodation groove 18 for retention, or with the waterproof gasket 28 fit to the outer rim of the winding stem pipe 21 so as to abut to the abutment plane 25*a* in advance.

In this manner, the first male screw section 22 of the winding stem pipe 21 is screwed into the female screw section 17*a* of the pipe-attachment hole 17. At the last stage of this screwing, the intracase-band end section 23 of the winding stem pipe 21 protrudes into the intracase-band side of the case band 13, and the extracase-band end section 25 of the winding stem pipe 21 compresses the waterproof gasket 28, whereby the abutment plane 25*a* of the extracase-band end section 25 closely attaches to the outer plane 13*a* of the case band 13.

Next, the clamp ring 29 is screwed into the screw section 24 of the intracase-band end section 23 protruding inside of the case band 13. Then, this ring 29 is clamped using another tool, which is not shown, so as to closely attach the clamp ring 29 to the inner plane 13*b* of the case band 13. In this case, by retaining the not-shown above-mentioned tool with it engaged to the engagement section 27, it allows to realize the clamp operation of the clamp ring 29 while preventing the winding stem pipe 21 from rotating.

By going through such a procedure, the extracase-band end section 25 of the winding stem pipe 21 screwed into the pipe-attachment hole 17 and the clamp ring 29 sandwich the pipe-attachment hole 17 of the case band 13 and therearound. As such, the winding stem pipe 21 is completely attached to the case band 13. This state of attachment completion is shown in FIG. 4.

Thereafter, attachment of the crown 31 is to be carried out. In this case, first, the crown tube section 33 of the crown 31 is inserted into the winding stem pipe 21 from the extracase-band side with the winding stem 37 connected thereto, and the female screw section 35 of the crown main section 32 is screwed with the second male screw section 26 of the winding stem pipe 21, and then clamped with positive rotation (right rotation). When the crown 31 is screwed into the second male screw section 26 to the furthest point, the crown main section 32 is defined by position when abutting to the outer plane 13*a* of the case band 13 as shown in FIG. 2 so that the extracase-band end section is 25 is entirely covered. Here, after such a procedure is through, the winding stem 37 and the watch movement are connected together.

Through such assembly, the waterproof capability is exerted and retained around the winging stem pipe 21. That is, waterproof between the winding stem pipe 21 and the case band 13 can be secured thanks to the waterproof gasket 28 sandwiched therebetween by changing in shape due to its elasticity through compression. Further, waterproof between the winding stem pipe 21 and the crown tube section 33 internally inserted thereinto can be secured thanks to the inner waterproof gasket 36 sandwiched therebetween by changing in shape due to its elasticity through compression.

In the divers watch 11 assembled as shown in FIG. 2, the crown 31 is engaged with the second male screw section 26 for screw locking. This prevents the crown 31 from accidentally rotating when carried around, whereby time display and others do not change. For time adjustment, the crown 31 is rotated in the reverse direction so as to disengage the second male screw section 26 from the crown main section 32. Thus, for the purpose, the crown 31 is pulled out against the spring forces of the coil spring 39.

Responding to attachment or removal of the crown 31 to/from the second male screw section 26 of the extracase-band end section 25, effected are the forces for rotating the winding stem pipe 21. In detail, in the first embodiment, in a case of locking the crown 31, effected are the forces in the direction of enforcing screwing of the winding stem pipe 21 to the pipe-attachment hole 17. On the other hand, in a case of releasing the screw lock of the crown 31, effected are the forces in the direction of loosening screwing of the winding stem pipe 21 to the pipe-attachment hole 17.

In the former case, the winding stem pipe 21 does not loosen, and thus the waterproof capability of the waterproof gasket 28 is not reduced. On the other hand. in the latter case, the winding stem pipe 21 tends to loosen, but actually, does not loosen due to the following reasons.

That is, the winding stem pipe 21 is fixed in the axial direction not to move by the clamp ring 29 screwed into the intracase-band end section 23 and the extracase-band end section 25. Moreover, the screw section 24 screwed with the clamp ring 29 is structured to be a reverse screw to the first male screw section 22 of the winding stem pipe 21 screwed into the pipe-attachment hole 17 of the case band 13. Accordingly, when the winding stem pipe 21 receives the rotation forces in the direction to loosen, the clamp ring 29 is clamped to a greater degree. In such a manner, it becomes possible to prevent the winding stem pipe 21 from loosening without fixing the winding stem pipe 21 to the case band 13 using adhesive. As a result, the waterproof gasket 28 sandwiched between the winding stem pipe 21 and the case and 13 can retain its waterproof capability.

If the screw lock capability of the crown 31 is reduced due to damage or wear-out of the second male screw section 26 and the female screw section 35 screwed thereinto, the divers watch 11 of the present embodiment can be dealt with as follows.

In detail, the clamp ring 29 can be removed from the intracase-band end section 23 of the winding stem pipe 21 in the intracase-band side, and the winding stem pipe 21 can be also removed from the case band 13 as being screw-in type. Thus, if the screw lock capability is reduced, the winding stem pipe 21 and the crown 31 can be separately exchanged. Further, to polish the extracase plane 13*a* at the time of exchange, the winding stem pipe 21 will be kept out of the way.

The winding stem pipe 21 and therearound can be disassembled in a reverse manner to the assembly procedure described above. In this case, a specifically-designed tool, which is not shown, having engaged with the clamp ring 29 is used to prevent the clamp ring 29 from rotating, or the clamp ring 29 is rotated in the loosening direction using the specifically-designed tool. At the same time, the hexagon wrench engaged to the engagement section 27 is used to rotate the winding stem pipe 21 in the loosening direction, so that the clamp ring 29 can be removed from the winding stem pipe 21. Then, the winding stem pipe 21 is rotated in the direction to loosen, thereby removing the winding stem pipe 21 from the case band 13.

Through such disassembly and assembly, for a person asking for repairment, when the screw lock capability is reduced, there is no need to exchange the watch exterior assembly 12 including the case band 13, and the like. However, only component exchange of the crown 31 and the winding stem pipe 21 for screw locking it will do, reducing the cost payment.

Figure 6:
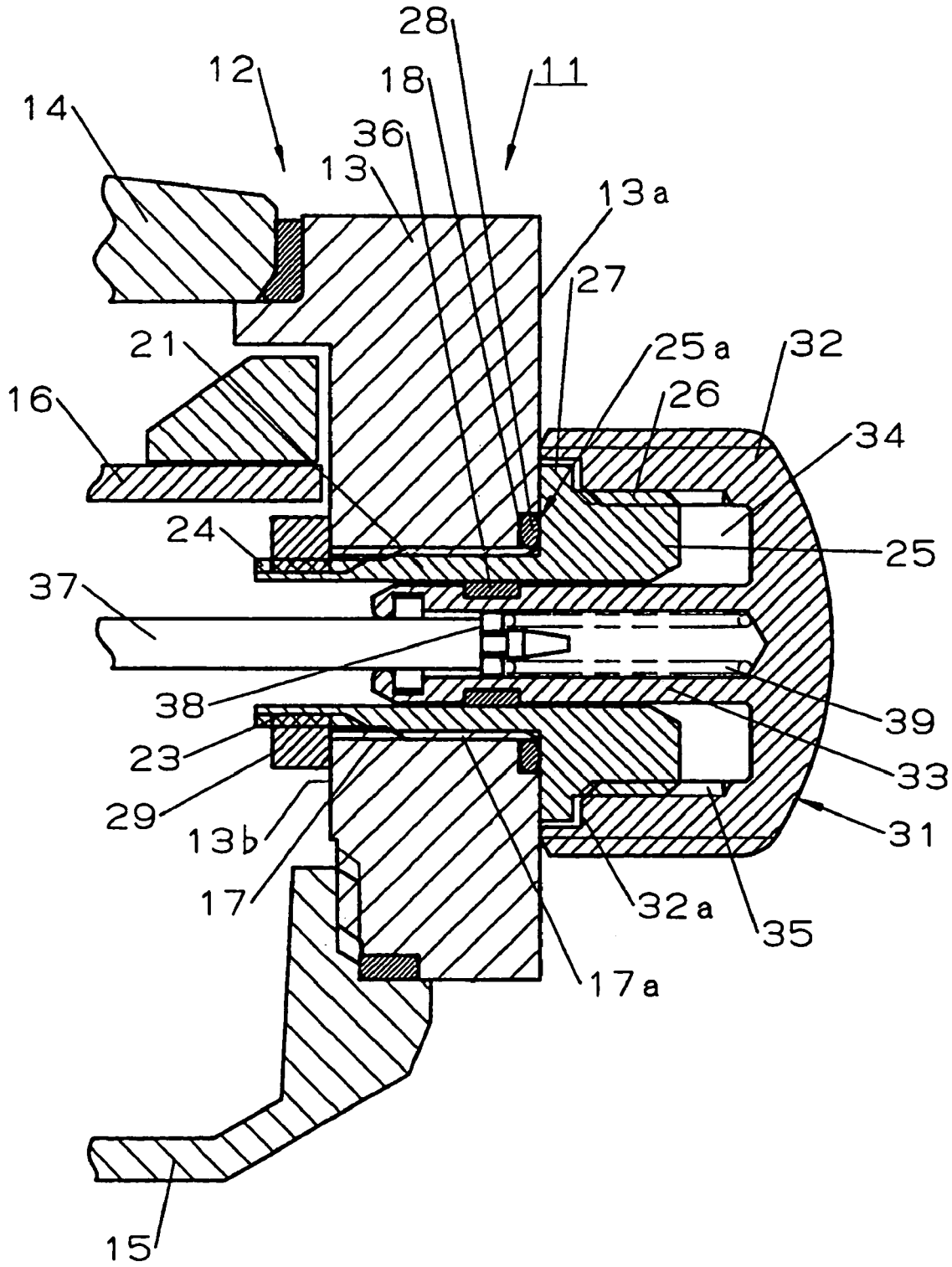
FIG. 6 is a crosssectional view showing the winding-stem-pipe-attachment section of a divers watch according to a second embodiment of the present invention.
Figure 7:
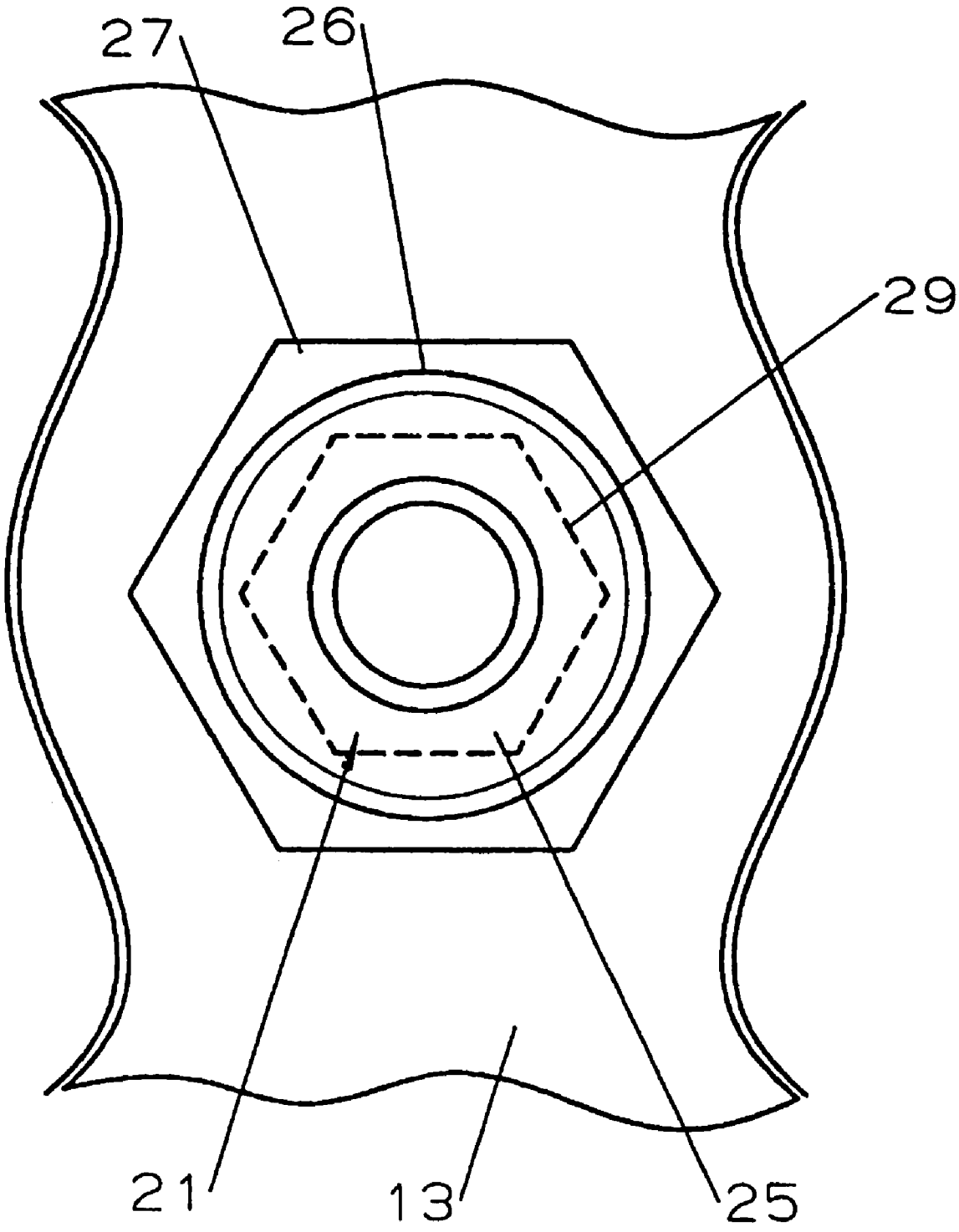
FIG. 7 is a front view of the winding-stem-pipe-attachment section with a crown of the divers watch of FIG. 6 removed.

FIGS. 6 and 7 show a second embodiment of the present invention. This embodiment is substantially the same as the first embodiment, and thus any identical structure to that of the first embodiment is provided with the same reference numeral, and not described again. Described are only structures different from the first embodiment.

In the second embodiment, the engagement section 27 provided to the extracase-band end section 25 of the winding stem pipe 21 is made to be a polygon, e.g., hexagon, exposing toward the outer rim plane of the extracase-band end section 25. This engagement section 27 is made larger than the second male screw section 26, and provided closer to the intracase-band end section 23 than the second male screw section 26. The side plane of the intracase-band end section 23 is placed flush with the abutment plane 25*a*. To this hexagon engagement section, at the time of attachment or removal of the winding stem pipe 21 to/from the case band 13, a tool such as spanner can be used from the direction orthogonal to the axial direction of the winding stem pipe 21.

Due to this engagement section 27 provided as such, there is no more square hole opening toward the engagement section described in the first embodiment, that is, the end plane of the extracase-band end section 25. Also, the crown main section 32 is formed with a clearance section 32*a* for preventing interference with the hexagon engagement section 27. Herein, the structures other than the above are the same as the first embodiment.

Therefore, also in this embodiment, the winding stem pipe 21 is provided with the screw section 24 being a reverse screw to the first male screw section 22 screwed with the pipe-attachment hole 17. The clamp ring 29 screwed to this screw section 24 and the extracase-band end section 25 of the winding stem pipe 21 sandwich the pipe-attachment hole 17 of the case band 13 and therearound. Thus, responding to the operation for attaching or removing the crown 31 to/from the extracase-band end section 25, it can prevent the winding stem pipe 21 from loosening. Moreover, the engagement section 27 of the second embodiment is formed to the outer rim of the extracase-band end section 25. Thus, compared with the case of forming the engagement section by a square hole, it is easy to process.

The present invention is not restrictive to the above embodiments. For example, the engagement section 27 may be formed by a negative or a positive groove opening toward the end plane or the rim plane of the extracase-band end section 25, so that the cutting edge of the screw may be engaged thereto. Further, two or more types of the engagement sections described above may be provided to the extracase-band end section 25. Moreover, the present invention can be applied to portable watches such as normal wrist watches or pocket watches that are not asking for waterproof capability under high voltage.

According to the present invention, when a winding stem pipe receives the rotation forces in the direction to loosen through operation done to a crown, a clamp ring screwed into a screw section being a reverse screw to a first male screw section of the winding stem pipe screwed into a case band is clamped to a greater degree. In this manner, there is no need to attach, using adhesive, the winding stem pipe screwed into the case band in a removable manner to prevent the winding stem pipe from loosening. Accordingly, when the screw lock capability is reduced, provided is a portable watch achieving component exchange of a crown and a winding stem pipe for screw locking it without exchanging the watch exterior assembly including a case band and others while retaining the waterproof capability of a winding-stem-pipe-attachment section by a waterproof gasket between the case band and the winding stem pipe.

According to the invention with the structure in which the outer diameter of a screw section of an intracase-band end section of a winding stem pipe is made smaller than the outer diameter of a first male screw section, provided is a portable watch allowing a winding stem pipe to be easily inserted or removed into/from a pipe-attachment hole while suppressing snagging of the inner plane of the pipe-attachment hole of the screw section locating in the intracase-band end section to a female screw section.

According to the invention in which a clamp ring is a square nut, at the time of attachment or removal of a clamp ring to/from an intracase-band end section of a winding stem pipe in the case band being narrow, a tool can be used from the direction orthogonal to the axial direction of the winding stem pipe. As such, provided is a portable watch having the better attachment/removal operability of a clamp ring.

According to the invention in which an engagement section engaging with a tool for rotating a winding stem pipe is provided in an extracase-band end section, provided is a portable watch enabling rotation of the winding stem pipe using a tool that is difficult to directly operate for rotation by hands, and retention of the winding stem pipe using the tool not to rotate when the clamp ring is attached or removed.

What is claimed is:

1. A portable watch, comprising:

a case band provided with a pipe-attachment hole having a female screw section;

a winding stem pipe extending through the pipe-attachment hole and having a first male screw section screwed together with the female screw section to removably attach the winding stem pipe to the case band, an intracase-band end section extending inside the case band and having a screw section that is a reverse screw from that of the first male screw section, and an extracase-band end section extending outside the case band and abutting an outer surface of the case band and having a second male screw section;

a clamp ring screwed together with the screw section of the intracase-band end section in a removable manner and engageable with an inner surface of the case band to hold the extracase-band end section in abutment with the outer surface of the case band;

a waterproof gasket sandwiched between the case band and the winding stem pipe; and a crown having a crown main section having a female screw section screwed together in a removable manner with the second male screw section.

2. A portable watch according to claim 1; wherein an outer diameter of the screw section of the intracase-band end section is smaller than an outer diameter of the first male screw section.

3. A portable watch according to claim 1; wherein the extracase-band end section includes an engagement section to be engaged with a tool to effect rotation of the winding stem pipe.

4. The portable watch according to claim 3; wherein the engagement section comprises a hole having a polygon shape.

5. A portable watch according to claim 1; wherein the crown has a crown tube section extending into the winding stem pipe so that an annular clearance exists within the crown main section around the crown tube section, and the extracase-band end section extends into the annular clearance.

6. A portable watch comprising: a case through which extends a hole having a female screw section; a winding stem pipe extending through the hole and having a first male screw section screwed together with the female screw section to removably attach the winding stem pipe to the case, a second screw section that extends into the interior of the case and has a reverse screw from that of the first male screw section, and a third male screw section that extends to the exterior of the case and abuts an outer surface of the case; a clamp ring screwed together with the second screw section and engaging with an interior surface of the band to hold the third male screw section in abutment with the outer surface of the case; a waterproof gasket disposed between the case and the winding stem pipe; and a crown having a crown main section that has a female screw section screwed together with the third male screw section to removably connect the crown to the winding stem pipe.

7. A portable watch according to claim 6; wherein the first, second and third screw sections are axially spaced from one another in an axial direction of the winding stem pipe.

8. A portable watch according to claim 6; wherein an outer diameter of the second screw section is smaller than an outer diameter of the first male screw section, and the outer diameter of the first male screw section is smaller than an outer diameter of the third male screw section.

9. A portable watch according to claim 6; wherein the waterproof gasket is elastically deformable and is disposed in a groove formed in the outer surface of the case surrounding the hole so that screwing of the first male screw section of the winding stem pipe into the female screw section of the case elastically deforms the waterproof gasket.

10. A portable watch according to claim 6; wherein the female screw section of the crown and the third male screw section of the winding stem pipe extend for a length sufficient to enable the crown to be screwed in one direction until the crown comes into contact with the outer surface of the case thereby locking the crown in position and to be screwed in the other direction until the female screw section of the crown disengages from the third male screw section of the winding stem pipe thereby unlocking the crown from the winding stem pipe so that the crown may be pulled outwardly to adjust a function of the portable watch.

11. A portable watch according to claim 6; wherein the crown has a crown tube section slidably extending into the winding stem pipe so that an annular clearance exists within the crown main section around the crown tube section, and the third male screw section of the winding stem pipe extends into the annular clearance.

12. A portable watch according to claim 11; wherein the first, second and third screw sections are axially spaced from one another in an axial direction of the winding stem pipe.

13. A portable watch according to claim 11; wherein an outer diameter of the second screw section is smaller than an outer diameter of the first male screw section, and the outer diameter of the first male screw section is smaller than an outer diameter of the third male screw section.

* * * * *